United States Patent [19]

Sato et al.

[11] Patent Number: 4,975,219

[45] Date of Patent: Dec. 4, 1990

[54] CORROSION INHIBITOR FOR BOILER WATER SYSTEMS

[75] Inventors: Takatoshi Sato; Takayasu Ueda; Kenji Kobayashi, all of Tokyo, Japan

[73] Assignee: Kurita Water Industries, Ltd., Tokyo, Japan

[21] Appl. No.: 295,626

[22] Filed: Jan. 10, 1989

[30] Foreign Application Priority Data

Feb. 18, 1988 [JP] Japan ..... 63-36364

[51] Int. Cl.[5] ..... C23F 11/10

[52] U.S. Cl. ..... 252/388; 252/389.52; 252/389.62; 252/389.23

[58] Field of Search ..... 252/393, 389.2, 388, 252/389.52, 389.62, 389.23

[56] References Cited

U.S. PATENT DOCUMENTS

| | | | |
|---|---|---|---|
| 1,988,823 | 1/1935 | Winning et al. | 252/155 |
| 4,105,406 | 8/1978 | Murray | 252/389.2 |
| 4,209,398 | 6/1980 | Ili et al. | 252/389.2 |
| 4,436,628 | 4/1984 | Ralston et al. | 252/389.2 |
| 4,512,915 | 4/1985 | Lumaret et al. | 210/765 |
| 4,562,042 | 12/1985 | Moran | 422/13 |
| 4,705,660 | 11/1987 | Malik | 264/108 |
| 4,885,136 | 12/1989 | Katayama et al. | 252/388 |

FOREIGN PATENT DOCUMENTS 1434804 5/1976 United Kingdom .

OTHER PUBLICATIONS

Chemical Abstracts 109(10) Abstract No. 79478n, Katayama et al., "A Method for Anticorrosive Treatment for Soft Water Boilers".

Chemical Abstracts 105(20), Abstract No. 178188s, Cuisia et al., "Scale Inhibiting Composition".

Chemical Abstracts 78(22): Abstract No. 139183r, Foraulis et al., "Corrosive Inhibitors for Aqueous Systems".

*Primary Examiner*—Robert L. Stoll
*Assistant Examiner*—Valerie D. Fee
*Attorney, Agent, or Firm*—Kanesaka and Takeuchi

[57] ABSTRACT

A corrosion inhibitor which comprises tannic acid and/or salt thereof; a sugar; and at least one member selected from aldonic acids or hexoses or salts thereof and aldonic acids of heptoses of salts thereof.

8 Claims, No Drawings

CORROSION INHIBITOR FOR BOILER WATER SYSTEMS

FIELD OF THE INVENTION AND RELATED ART STATEMENT

The present invention relates to a corrosion inhibitor for protecting metals contacted with water, in particular, to a corrosion inhibitor useful for boiler water systems.

In hitherto known corrosion inhibitors for use in medium and low pressure boiler water systems, hydrazines, sulfites or sugars have been employed as major effective chemicals.

However, usage of hydrazines is avoided in such a case where steam generated is used for the processing of foods, or in such a case where steam generated may come into direct contact with human bodies.

Usage of sulfites is accompanied by generation of a corrosion causing factor, i.e., sulfite ion. It is therefore necessary to strictly control the concentration of sulfite ions. However, strict control of the concentration of sulfite ions requires much operational skill and hence is highly troublesome.

Sugar-containing inhibitors (e.g., scale inhibitors containing glucose together with tannin) have long been employed. However, known inhibitors of this type are insufficient in their corrosion inhibiting capability. Tannic acid has also been used as a corrosion inhibitor for boilers. However, tannic acid is expensive, and it is virtually impossible to use the acid in large quantities.

OBJECTS AND SUMMARY OF THE INVENTION

It is therefore an object of the present invention to provide a corrosion inhibitor which exhibits excellent corrosion inhibiting function.

It is another object of the invention to provide a corrosion inhibitor which does not contain ingredients harmful to human bodies and therefore is usable in a boiler for generating steam for food processing or under conditions where it may come into direct contact with human bodies.

It is a further object of the invention to provide a corrosion inhibitor which does not require no strict control of its concentration in water systems.

DETAILED DESCRIPTION OF PREFERRED EMBODIMENTS

There is provided by the present invention a corrosion inhibitor which comprises tannic acid or a salt thereof; a sugar; and an aldonic acid of hexoses or heptoses and/or a salt thereof.

As examples of salts of tannic acid usable in the invention, there may be sodium tannate, potassium tannate, ammonium tannate, and the like.

As examples of sugars usable in the invention, there may be D-glucose, fructose, mannose, galactose, and the like.

As examples of aldonic acids of hexoses usable in the invention, there may be hexonic acids, such as gluconic acid, allonic acid, altronic acid, mannonic acid, galactonic acid, etc. As examples of aldonic acids of heptoses usable in the invention, there may be glucoheptonic acid, mannoheptonic acid, galactoheptonic acid, etc.

In these aldonic acids, gluconic acid and gluconoheptonic acid are preferable in respect of effectiveness and availability.

As examples of salts of aldonic acids usable in the invention, there may be sodium, potassium and ammonium salts of aldonic acids.

The corrosion inhibitor of the invention may contain 100 to 500 parts by weight, preferably 250 to 500 parts by weight of sugars, and 100 to 2,000 parts by weight, preferably 400 to 1,500 parts by weight of aldonic acids of hexoses or heptoses or salts thereof, per 100 parts by weight of tannic acid and/or salts thereof.

In the corrosion inhibitor of the invention, there may be used either tannic acid or a salt thereof, or both of them. The inhibitor may contain one or more aldonic acids of hexoses and heptoses and salts thereof.

In the practice of the invention, the three components can be admixed beforehand at a prescribed ratio and then added to a water system, or the components can be separately added to a water system up to prescribed concentrations.

The corrosion inhibitor of the invention can be used in any water systems. It can however be particularly useful as a corrosion inhibitor in boiler water systems to be subjected to heavy thermal load, especially in those where pure or soft water is used as feed water.

The corrosion inhibitor of the invention is preferably added to water systems to keep a concentration of from 500 to 2,000 ppm, in particular, from 1,000 to 1,500 ppm in the boiler water.

The corrosion inhibitor of the invention can additionally contain pH regulators, scale inhibitors and other corrosion inhibitors, such as neutralizing amines.

There is no particular restriction on the kind of pH control agents to be employed. As examples of usable pH control agents, mention may be made of sodium hydroxide, potassium hydroxide, sodium carbonate, potassium carbonate, and the like.

There is no particular restriction on the kind of scale inhibitors to be additionally employed. As examples of usable scale inhibitors, there may be phosphates, such as sodium primary, secondary and tertiary phosphates, sodium triphosphate, sodium hexametaphosphate, etc., and watersoluble polymers, such as sodium polyacrylates, etc.

As non-restrictive examples of other usable corrosion inhibitors, there may be neutralizing amines and filming amines. Usable neutralizing amines include, e.g., cyclohexylamine, morpholine and aminomethylpropanol. Usable filming amines include, e.g., laurylamine, polyalkydpolyamines and polyalkylimidazolines.

It can be preferable to use pH control agents in an amount of 3,000 parts by weight or less, in particular, 2,000 parts by weight or less; scale inhibitors in an amount of 1,000 parts by weight or less, in particular, 500 parts by weight or less; and other corrosion inhibitors in an amount of 1,000 parts by weight or less, in particular, 500 parts by weight or less; per 100 parts by weight of tannic acid and/or salts thereof.

Tannic acid reacts with iron to form iron tannate. Aldonic acids of hexoses and heptoses also react with iron, thereby forming iron hexonates and heptonates, respectively. These iron salts act synergistically to form a dense anti-corrosive film on the surface of iron. It is presumed that sugars eliminate oxygen which is present in the vicinity of the surface of iron, thus making the anticorrosive film more stable.

In the corrosion inhibitor of the invention, the three components exhibit synergistic effects. In addition, the corrosion inhibitor does not contain components which might cause adverse effects to human bodies. Furthermore, no strict control of concentration of the components is required. The corrosion inhibitor therefore can be highly useful.

The corrosion inhibitor of the invention will further be explained by way of examples and comparative examples.

EXAMPLE 1

In this example was used a softened water as a feed water having a pH of 10.5, an electric conductivity of 350 $\mu$S/cm and an alkalinity of 35 ppm (as $CaCO_3$) and containing 50 ppm of chloride ions (as $Cl^-$), 50 ppm of sulfate ions (as $SO_4^{2-}$) 20 ppm of silica (as $SiO_2$) and 10 ppm of dissolved oxygen.

To 1 liter of this feed water were added (a) tannic acid, (b) D-glucose and (c) sodium $\alpha$-D-glucoheptonate in quantities shown in Run Nos. 8 to 10. The resulting water was fed to a test boiler.

The test boiler was fitted with a test tube made of mild steel (inner diameter, 20 mm; test length, 900 mm; and distance between the fitting flanges at the ends of the tube, 1,100 mm). At the outlet of the test tube were fitted two test pieces made of mild steel (15 mm×30 mm×2 mm; 10.8 cm$^2$).

The boiler was set at a pressure of 10 kg/cm$^2$-G and at a temperature of 183° C., and the flow velocity in the test tube and on the surface of the test pieces was set at 1 m/sec. The boiler was operated with the boiler water concentration number of 10 (the boiler water concentration number shows concentration ratio of salts or solved solids in boiler water compared with feed water).

The operation of the boiler was stopped after 96 hours from the start of the test. After cooling, the test tube and the test pieces were taken out, and their surfaces were observed to examine whether corrosion had been generated or not. The reduction in weight of the test pieces and their corrosion inhibition rate were calculated according to the following formula:

$$[\text{Reduction in weight (mg)}] = [\text{Initial weight (mg)}] - [\text{Weight after derusting (mg)}]$$

$$[\text{Corrosion inhibition rate \%}] = \frac{[\text{Weight reduction in Control (mg)}] - [\text{Weight reduction in the test (mg)}]}{[\text{Weight reduction in Control (mg)}]} \times 100$$

For the purpose of comparison, the above test procedure was repeated, using Components (a), (b) and (c) in quantities shown in Run Nos. 2 to 7 in Table 1.

Results obtained are also shown in Table 1.

TABLE 1

| | Run No. | Amount Added (mg) (a) | (b) | (c) | Corrosion Test Tube | Corrosion Test Piece | Test Piece Reduction in Weight (mg) | Test Piece Corrosion Inhibition Rate (%) |
|---|---|---|---|---|---|---|---|---|
| Control | 1 | 0 | 0 | 0 | Pitting generated | Pitting generated | 7.6 | — |
| Comparative Examples | 2 | 4 | 0 | 0 | Pitting generated | No pitting generated | 4.5 | 41 |
| | 3 | 0 | 20 | 0 | Pitting generated | Pitting generated | 4.6 | 39 |
| | 4 | 0 | 0 | 20 | Pitting slightly generated | No pitting generated | 4.5 | 23 |
| | 5 | 4 | 0 | 15 | Pitting slightly generated | No pitting generated | 4.3 | 43 |
| | 6 | 0 | 5 | 15 | Pitting slightly generated | No pitting generated | 5.4 | 29 |
| | 7 | 4 | 5 | 0 | Pitting slightly generated | No pitting generated | 4.0 | 47 |
| Examples According to the Invention | 8 | 1 | 5 | 10 | No pitting generated | No pitting generated | 4.3 | 43 |
| | 9 | 1 | 5 | 15 | No pitting generated | No pitting generated | 2.2 | 71 |
| | 10 | 2 | 5 | 10 | No pitting generated | No pitting generated | 1.1 | 86 |

It would be understood from the results shown in Table 1 that the corrosion inhibitor of the invention is capable of effectively preventing the generation of pitting and exhibits excellent corrosion inhibition rates.

EXAMPLE 2

Corrosion inhibition tests were carried out in the same manner as in Example 1, except that sodium gluconate was used as component (c) instead of sodium $\alpha$-D-glucoheptonate.

Results obtained are shown in Table 2.

TABLE 2

| | Run No. | Amount Added (mg) (a) | (b) | (c) | Corrosion Test Tube | Corrosion Test Piece | Test Piece Reduction in Weight (mg) | Test Piece Corrosion Inhibition Rate (%) |
|---|---|---|---|---|---|---|---|---|
| Comparative | 1 | 0 | 0 | 10 | Pitting | Pitting | 6.5 | 14 |

TABLE 2-continued

| | Run No. | Amount Added (mg) (a) | (b) | (c) | Corrosion Test Tube | Test Piece | Test Piece Reduction in Weight (mg) | Corrosion Inhibition Rate (%) |
|---|---|---|---|---|---|---|---|---|
| Examples | | | | | slightly | generated | | |
| | 2 | 4 | 0 | 15 | Pitting slightly generated | No pitting generated | 4.5 | 41 |
| | 3 | 0 | 5 | 10 | Pitting slightly generated | No pitting generated | 4.5 | 41 |
| Example According to the Invention | 4 | 2 | 5 | 10 | No pitting generated | No pitting generated | 1.9 | 75 |

It would be understood from the results shown in Table 2 that excellent results can be obtained also in the case where sodium gluconate is employed.

What is claimed is:

1. A corrosion inhibitor comprising tannic acid and/or a salt thereof; a sugar for boiler water systems; and at least one member selected from the group consisting of aldonic acids of hexoses or salts thereof and aldonic acids of heptoses or salts thereof.

2. A corrosion inhibitor comprising 100 to 500 by weight of a sugar for boiler water systems; and 100 to 2,000 parts by weight of one or more members selected from the group consisting of aldonic acids of hexoses or salts thereof and aldonic acids of heptoses; and 100 parts by weight of tannic acid and/or a salt thereof.

3. A corrosion inhibitor as claimed in claim 1, in which a pH control agent, a scale inhibitor and/or one or more of other corrosion inhibitors are additionally contained.

4. A corrosion inhibitor as claimed in claim 2, in which not more than 3,000 parts by weight of pH control agents, not more than 1,000 parts by weight of scale inhibitors, and/or not more than 1,000 parts by weight of one or more of other corrosion inhibitors are additionally contained.

5. A corrosion inhibitor as claimed in claim 3, wherein said pH regulator is selected from the group consisting of sodium hydroxide, potassium hydroxide, sodium carbonate and potassium carbonate.

6. A corrosion inhibitor as claimed in claim 3, wherein said scale inhibitor is phosphate.

7. A corrosion inhibitor as claimed in claim 6, wherein said phosphate is selected from the group consisting of sodium primary, secondary and tertiary phosphates, sodium tripolyphosphate and sodium hexametaphosphate.

8. A corrosion inhibitor for boiler water systems consisting essentially of tannic acid and/or a salt thereof; a sugar; and at least one member selected from the group consisting of aldonic acids of hexoses or salts thereof and aldonic acids of heptoses or salts thereof.

* * * * *